United States Patent [19]

Bates, III et al.

[11] 4,147,286

[45] Apr. 3, 1979

[54] COLLAPSIBLE HAND CARRIER

[76] Inventors: Claude F. Bates, III; Duane R. Olson, both of 17801 SW. 112 Pl., Miami, Fla. 33157

[21] Appl. No.: 857,294

[22] Filed: Dec. 5, 1977

[51] Int. Cl.[2] ..... A47G 23/06

[52] U.S. Cl. ..... 224/48 D; 224/45 R

[58] Field of Search ..... 224/45 R, 45 A, 46 R, 224/46 T, 48 R, 48 A, 48 B, 48 D; 150/49; 248/97, 98; 280/651, 659

[56] References Cited

U.S. PATENT DOCUMENTS

| | | | |
|---|---|---|---|
| 3,633,932 | 1/1972 | Holden | 248/98 X |
| 3,830,418 | 8/1974 | Newell | 224/45 R X |
| 3,893,607 | 7/1975 | Jones | 224/45 R |

FOREIGN PATENT DOCUMENTS

| | | | |
|---|---|---|---|
| 481795 | 3/1952 | Canada | 224/48 D |
| 652953 | 11/1962 | Canada | 280/651 |
| 1406078 | 6/1964 | France | 150/49 |

*Primary Examiner*—Trygve M. Blix
*Assistant Examiner*—Winston H. Douglas
*Attorney, Agent, or Firm*—Ernest H. Schmidt

[57] ABSTRACT

A collapsible hand carrier for carrying one or two side-by-side grocery bags or the like has a U-shaped, inverted handle member between the lower ends of which are pivotally secured inner end portions of a pair of opposed rectangular bottom panels the outer ends of which have pivotally secured thereto lower end portions of opposed side panels. The upper end corners of the side panels are linked to each other and to central portions along the length of the handle member at each side to provide substantially parallel guide mechanism operation of the side panels with respect to the plane of the handle, thereby to permit compact collapsing of the bottom and side panels against each side of the handle member. One of the bottom panels has an extended portion which overlays the underside of the other bottom panel when the carrier is in the open condition of use, and which extends outwardly of the other bottom panel when the carrier is collapsed to permit use as a hand grip for carrying the container in inverted position when collapsed.

1 Claim, 4 Drawing Figures

FIG. 1.
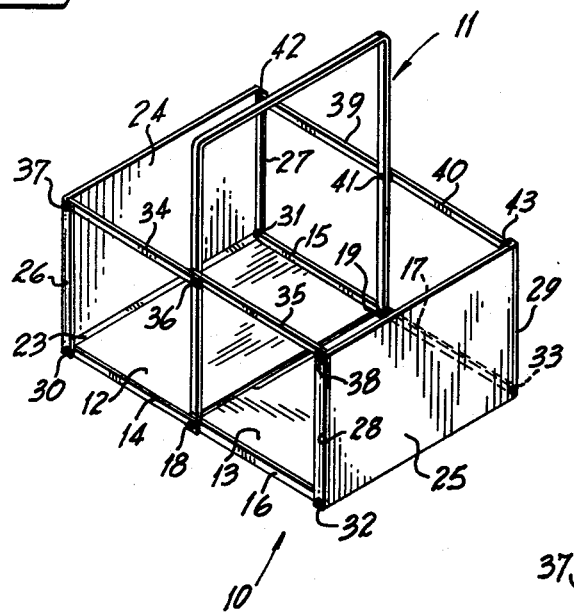
FIG. 2.
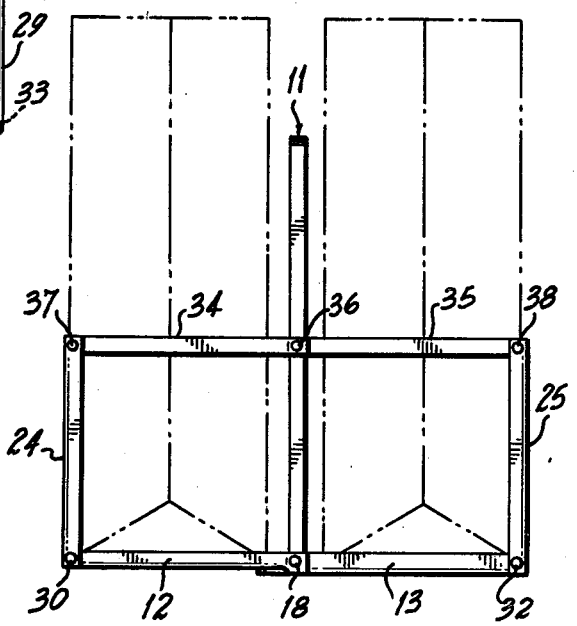
FIG. 3.
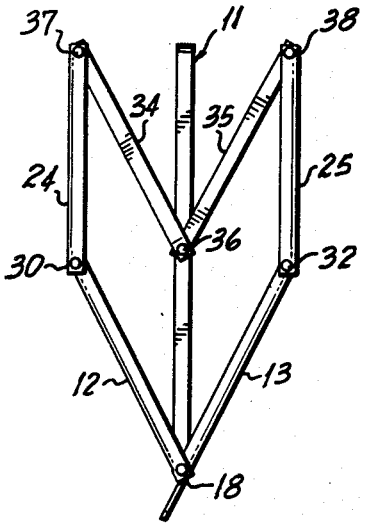
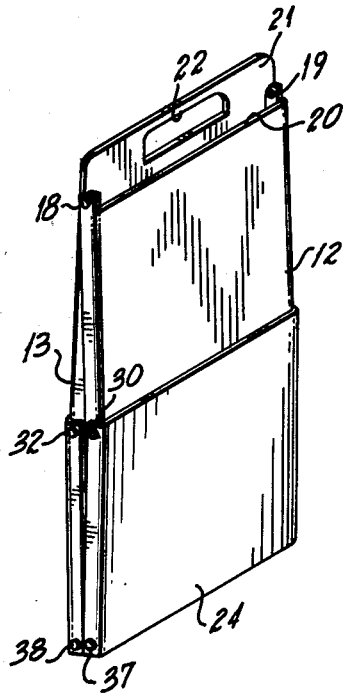
FIG. 4.

COLLAPSIBLE HAND CARRIER

This invention relates to hand carriers or basket-like containers or carriers for carrying from place to place one or more articles that would otherwise be difficult to carry, and is directed particularly to such carriers that are compactly collapsible or foldable for convenience in carrying and storage when not being used for carrying articles.

In grocery shopping, for example, the groceries are usually packed in large paper bags that are often quite heavy and difficult and awkward to carry. When there are two or more packed bags to carry it is customary to use a shopping cart for carrying them to the parking area where they can be individually loaded for transportation. In many supermarkets, however, use of shopping carts outside of the store is not permitted unless under the control of the "bag boy" or other store employee. Also when this service is not available, the shopper must provide for his or her own means for carrying out of the grocery bags. It is, accordingly, the principal object of this invention to provide a hand carrier for grocery bags and the like which can be used for carrying one or two heavy grocery bags with ease and with firm support at the sides of the bag to minimize any possibility of a bag breaking or tearing.

It is another object of the invention to provide a hand carrier for grocery bags and other objects of like size, such as six-pack canned or bottled beverages, that can be compactly collapsed or folded when not in use to facilitate empty carrying and storage.

Another object of the invention is to provide a collapsible hand carrier of the above nature which, when fully collapsed, can easily be carried in pairs with the use of one hand for use in carrying three or more grocery bags, one filled carried in each hand, in a single trip.

Another object is to provide a collapsible hand carrier of the above nature that can readily be fabricated of light-weight sheet metal such as sheet aluminum, and which will be inexpensive to manufacture, light in weight, and durable in use.

Other objects, features and advantages of the invention will be apparent from the following description when read with reference to the accompanying drawings. In the drawings, wherein like reference numerals denote corresponding parts throughout the several views:

FIG. 1 is an oblique view of a preferred form of collapsible hand carrier embodying the invention, as view from above;

FIG. 2 is a side elevational view thereof, on an enlarged scale;

FIG. 3 is a side elevational view as in FIG. 2, showing the carrier partially folded in the process of collapsing together; and FIG. 4 is an oblique view showing the basket fully folded or collapsed, and inverted end-for-end for carrying while in collapsed condition.

Referring now in detail to the drawings, reference numeral 10 designates, generally, a foldable basket or carrier embodying our invention, the same preferably being fabricated of light-weight metal, such as sheet aluminum. The foldable basket 10 comprises a rectangular, U-shaped, inverted handle member 11, fabricated of flat bar stock. Pivotally attached to lower end portions of the inverted rectangular handle 11 are rectangular sheet metal bottom panels 12, 13, each of which is formed with upwardly-bent side flange portions 14, 15 and 16, 17, respectively. As illustrated in FIGS. 1 and 2, when the carrier 10 is in unfolded or use condition, the bottom panels 12, 13 extend outwardly of the lower ends of the inverted U-shaped handle member 11 in opposed relation, and lie in a substantially common plane perpendicular to said handle. A marginal inner end portion of the bottom panel 12 is cut away as indicated at 20 (see FIG. 4). The inwardly projecting ends of the side flange portions 14, 15 thus defined overlap inner end portions of the upwardly bent flange portions 16, 17 of bottom panel 13, and are pivotally journalled with respect thereto and with respect to lower end portions of the inverted, U-shaped handle member 11 as by respective headed pivot pins 18, 19. The bottom panel 13, moreover, has an extended marginal portion 21 which overlaps, at the underside, the bottom panel 12 when the carrier is in the open position of use, as illustrated in FIGS. 1 and 2. As best illustrated in FIG. 4, the extended marginal portion 21 is provided along its length with an elongated hand grip opening 22 used for carrying the collapible carrier when in collapsed condition, as is hereinafter more particularly described. The opposed outer ends of the sheet metal bottom panels 12, 13 are formed with acute, angularly upturned marginal edge portions 23 (marginal edge portion 23 only of bottom panel 12 visible in FIG. 1).

Pivotally joined to outer end portions of bottom panels 12 and 13, are upwardly-extending, sheet-metal side panels 24, 25, respectively, said side panels being formed with inturned marginal flanges 26, 27 and 28, 29, respectively, lower end portions of which are pivotally joined with respect to outer end portions of flange portions 14, 15 and 16, 17 as by headed pivot pins 30, 31 and 32, 33. Rectangular link bars 34, 35 pivotally interconnect upper end portions of the inturned marginal flanges 26, 28 at one side of the carrier with each other and with a central portion of the U-shaped, inverted carrier handle at the same side of the carrier as by central headed pivot pin 36 and end pins 37, 38. Similarly, rectangular link bars 39, 40 pivotally interconnect upper end portions of the inturned marginal flanges 27, 29, at the other side of the carrier with each other and with a central portion of the U-shaped, inverted carrier handle as by central headed pivot pin 41 and end pins 42 and 43. As is clearly illustrated in FIGS. 1 and 2, the lengths of the link bars 34, 35, 39 and 40 and their points of pivotal connection with the sides of handle 11 are such as to define a rectangle with the associated flange portions of the sheet metal bottom panels 12, 13 and sheet metal side panels 24, 25. Moreover, the lower end portions of the handle member 11 between pivot pins 36 and 18, and 41 and 19, vertically divide the thus defined rectangular configuration in half so that, as illustrated in FIG. 3, each side panel 24, 25 can be pushed upwardly to collapse against the central handle member 11. The height of the handle member 11 above the central pivot pins 36, 41, moreover is no greater than the length of the link bars, 34, 35, 39 and 40 so that when the carrier is fully collapsed, as illustrated in FIG. 4, it will not project outwardly of the upper ends of sheet metal side panels 24, 25. When fully collapsed as illustrated in FIG. 4, the extended portion 21 of bottom panel 13 will project outwardly of the bottom panel 12 to permit use of the hand grip opening 22 for convenient carrying. In this connection it will be understood that while carrying the collapsed carrier it will have a tendency to maintain itself in such collapsed condition. Opening the carrier for use thereafter is readily accomplished by inverting again and spreading the side panels 24, 25 until they fall by their own weight to each side of the handle member 11. When the carrier attains its fully opened condition of use as illustrated in FIGS. 1 and 2, the flat, extended portion 21 bearing against the underside of an inner marginal portion of bottom panel 12 prevents further relative movement of said bottom panels.

FIG. 2 further illustrates, in phantom view, how two paper gracery bags can fit within the foldable carrier 10 for easy carrying. In this connection it is to be noted that the rigidity of the carrier when fully opened for use is such as to enable convenient carrying of only one bag at one side of the carrier.

While there is illustrated and described herein only one form in which our invention can conveniently be embodied in practice, it is to be understood that this embodiment is presented by way of example only and not in a limiting sense. Our invention, in brief, comprises all the embodiments and modifications coming within the scope and the spirit of the following claims.

What we claim is new and desire to secure by Letters Patent is:

1. A collapsible hand carrier comprising, in combination, a rectangular handle member of inverted, U-shaped configuration defining a substantially flat plane, a pair of rectangular bottom panel members, means pivotally journalling marginal inner edge portions of said bottom panel member along a lower edge portion of said handle member, a pair of rectangular side panel members, means pivotally securing said side panel members along one edge each with respect to outer marginal edge portions of said bottom panel members, and parallel guide mechanism interconnecting vertical edge portions of said rectangular handle member with opposed upper edge portions, respectively, of said side panel members to permit the upward folding of said bottom panel members and said side panel members against opposite sides of said handle member, said parallel guide mechanism comprising elongated link members pivotally interconnecting said vertical edge portions of said rectangular handle member with said upper edge portions of said side panel members, one of said bottom panels having an extended portion adapted to overlay the underside of the other of said bottom panel members when said hand carrrier is in its extended position of use, said bottom panels and said side panels being of sheet metal, and said bottom panel extended portion being provided with a hand grip opening to facilitate carrying when the hand carrier is fully collapsed, said handle member and said link members being fabricated of flat metal bar stock, said means pivotally journalling said bottom panel members to said handle member, and said means pivotally securing said side panel members to said bottom panel members each comprising rectangularly bent flange portions formed along marginal edge portions of said bottom panel members and said side panel members.

* * * * *